United States Patent [19]

Ausnit

[11] Patent Number: 4,479,244

[45] Date of Patent: Oct. 23, 1984

[54] EASY OPENING BAG

[76] Inventor: Steven Ausnit, 124 E. 61st St., New York, N.Y. 10021

[21] Appl. No.: 430,944

[22] Filed: Sep. 30, 1982

[51] Int. Cl.[3] ..... B65D 33/24

[52] U.S. Cl. ..... 383/63; 383/93

[58] Field of Search ..... 383/63, 64, 65, 78, 383/80, 93

[56] References Cited

U.S. PATENT DOCUMENTS

| | | | |
|---|---|---|---|
| Re. 28,969 | 9/1976 | Naito | 383/65 |
| 3,347,298 | 10/1967 | Ausnit et al. | 383/65 |
| 3,425,469 | 2/1969 | Ausnit | 383/65 |
| 3,532,571 | 10/1970 | Ausnit | 383/65 |
| 3,633,642 | 1/1972 | Siegel | 383/64 |
| 3,780,781 | 12/1973 | Uramoto | 383/65 |

*Primary Examiner*—Joseph Man-Fu Moy

[57] ABSTRACT

A reclosable plastic bag construction having front and back walls attached at their side edges with continuous elongate interlocking separable rib and groove elements along confronting faces of the walls adjacent the top of the bag with the rib and groove elements being interlockable by the application of closing pressure and having frictional surface means at their outer surface for applying local forces of opposing directions parallel to the rib and groove to cause a curl in the interlocked rib and groove and to thereby cause them to separate by relatively sliding the rib and groove axially relative to each other.

10 Claims, 7 Drawing Figures

FIG. 1
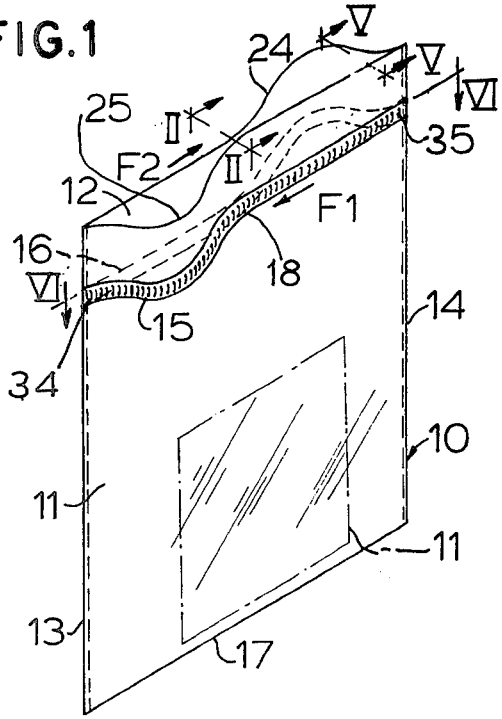
FIG. 2
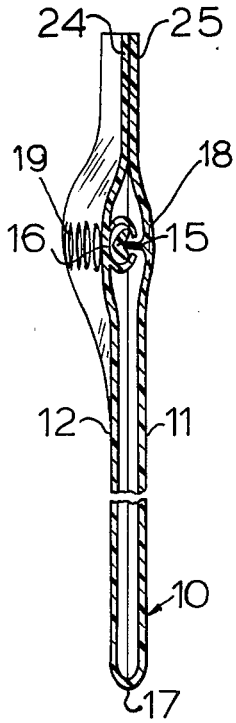
FIG. 6
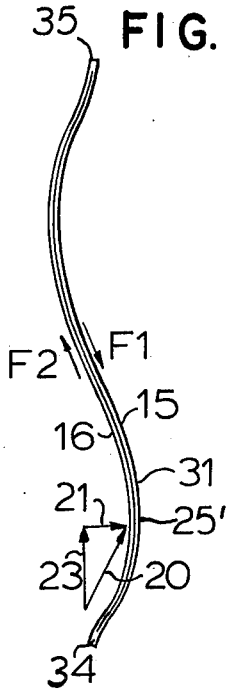
FIG. 4
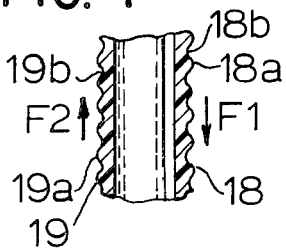
FIG. 3
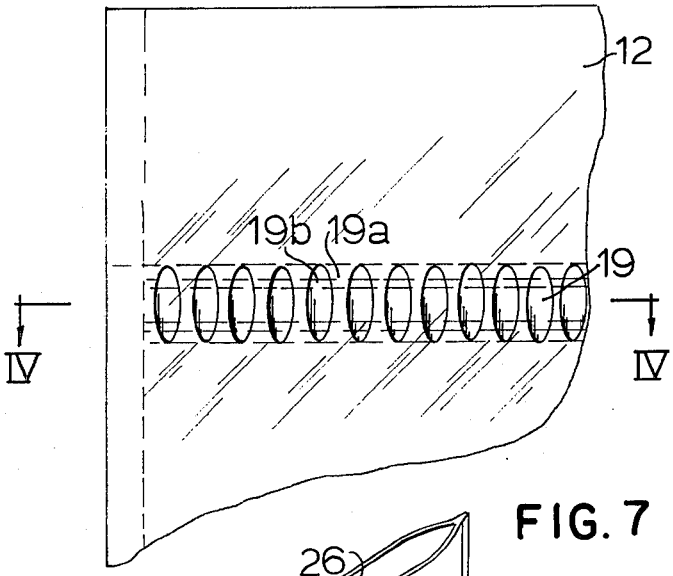
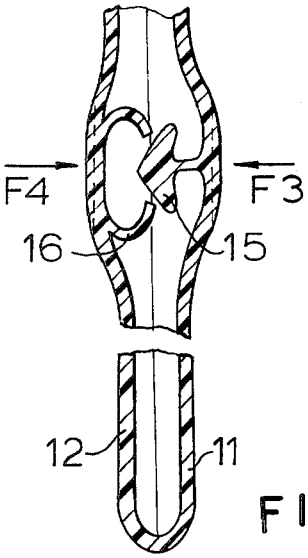
FIG. 5
FIG. 7
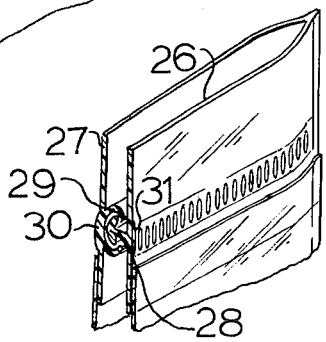

EASY OPENING BAG

BACKGROUND OF THE INVENTION

The present invention relates to an improved plastic bag construction and flexible fastener construction which incorporates pressure closable reopenable rib and groove elements. More particularly, the invention relates to an improved rib and groove fastener structure and method of opening the fastener structure which eliminates the need for pulling apart opposing flaps as has heretofore been necessary.

Reclosable zipper lock plastic bags generally are formed of flexible thin plastic film with front and side walls with the walls attached to each other along their sides and seams, and the walls attached along a bottom edge. The bag may be filled through the open bottom edge which is then sealed or may be filled through the top. Adjacent the top edge and extending fully across opposed confronting inner surfaces of the mouth of the bag are a pair of cooperatively interlocking fastener strip profiles formed with respective engageable rib and groove elements made of extruded plastic material. Examples of such bags and means of manufacture thereof are disclosed in U.S. Pat. Nos. 3,198,228, 3,291,177, 3,338,284 and 3,340,116. Plastic bags may have the zipper lock rib and groove elements integral with the bags or these zipper lock elements may comprise separate fastener strips which are attached to the top of bags. In either instance, the zipper lock rib and groove elements normally are extruded and are interlocked during manufacture for convenience of storage and handling. The rib and groove elements then must be separated for filling or for use. Typically, there are flange members extending above the rib and groove elements which flange members are gripped and pulled apart to separate the rib and groove for access to the interior of the bag.

Disadvantages are encountered in this manner of separating the rib and groove elements for opening the bag in that it is difficult to find and grasp the separate flange elements particularly when the bag is formed of a very thin plastic film. Also, if it is intended that the bags are to be handled by a machine and opened by machine for mechanical handling and filling, it is difficult to provide machine elements which will find and grip the flanges and pull apart the rib and groove elements.

Accordingly, it is an object of the present invention to provide an improved method and structure whereby interlocked rib and groove bag closure elements may be separated rapidly and easily without the necessity of grasping the flanges to pull the rib and groove elements apart.

It is another object of the invention to provide a structure and means for separating rib and groove elements rapidly by the application of simple mechanical force such as gripping the elements between the thumb and forefinger and sliding the elements longitudinally relative to each other.

SUMMARY OF THE INVENTION

An improved reclosable bag construction is provided with the bag having front and back walls attached by seams at their side edges. Continuous elongate interlocking separable rib and groove elements are provided along confronting faces at the top of the bag with the rib and groove elements attached to each other also at the bag edges. The rib and groove elements are interlocked with each other and have a frictional surface means on the outer surface of said walls such as by a series of ridges extending transversely of the direction of the rib and groove elements. These frictional means permit the application of opposed longitudinal forces tending to slide the rib and groove elements in opposite directions, and this may be accomplished by mechanical means or by the thumb and forefinger applying the opposed longitudinal forces at a force location which is generally at the center of the bag intermediate the bag side edges. As the longitudinal forces are applied and the rib and groove elements tend to slide with respect to each other, the bag top will curl in a general S shape with a curvature in one direction at one side of the location where the thumb and forefinger are attempting to slide the rib and grooves and in the opposition direction at the other side. The resistance to curling or the beam strength of the rib and groove will cause a force component to be present laterally of the rib and groove elements which tends to separate the rib and groove elements and as the force is increased, the rib and groove elements will spring apart, thus achieving rapid separation. The principles described apply whether the rib and groove elements are integral with the bag or a part of the fastener strips of the kind which can be attached to the top of a bag.

BRIEF DESCRIPTION OF THE DRAWINGS

FIG. 1 is a perspective view of a bag constructed in accordance with the principles of the present invention, illustrating the bag being opened in accordance with the method of the invention;

FIG. 2 is a vertical sectional view taken substantially along line II—II of FIG. 1;

FIG. 3 is a fragmentary enlarged view of a portion of the top of the bag of FIG. 1;

FIG. 4 is an enlarged fragmental sectional view taken substantially along line IV—IV of FIG. 3;

FIG. 5 is a fragmental vertical sectional view taken substantially along line V—V of FIG. 1;

FIG. 6 is a fragmentary somewhat schematic force diagram taken substantially along line VI—VI of FIG. 1; and FIG. 7 is a fragmentary perspective view of fastener strips embodying the principles of the present invention.

DESCRIPTION OF THE PREFERRED EMBODIMENTS

As illustrated in FIGS. 1 and 2, a bag 10 is formed of thin plastic film having a front wall 11 and a back wall 12. The walls are attached to each other at their side edges by seams 13 and 14, and the film is doubled at its lower edge 17 to form a closed bag with capabilities of holding contents such as shown schematically at 11.

Adjacent the top of the bag are pressure closable interlocking releasable rib and groove elements with the rib element shown at 15 and the groove element at 16. The rib and groove elements are complementary shaped so that they are pressure closable by applying a lateral or normal force to the elements pressing them together.

In one form of manufacture, the bag film and the reclosable elements are manufactured at the same time being extruded through a die, and the rib and groove elements 15 and 16 are pressed together to an interlocked relationship for storage and handling of the continuous strip of material. When the bags are formed, cross seams are formed to form the side edges 13 and 14 of the bags. The bag is normally formed in a tube which is slit to form the flanges 24 and 25 at the top of the bag. For opening the bag heretofore it was necessary to separate the flanges 24 and 25 and to grip them either by two hands between the thumb and forefinger or by mechanical means and pull the flanges apart to forcibly separate the rib 15 from the groove 16.

In accordance with the concepts of the present invention, the rib and groove elements are separated in order to open the bag by applying opposing forces parallel to the fastener elements 15 and 16. These forces are shown at $F_1$ and $F_2$ in FIGS. 1, 4 and 6 and tend to slide the rib and groove elements longitudinally with respect to each other to cause the fastener to curl as illustrated in FIG. 6.

For the application of the forces $F_1$ and $F_2$, the outer surfaces of the bag wall at the fastener elements 15 and 16 is roughened as shown at 18 and 19. The roughening provides a frictional surface means and in a preferred form, is shown as vertical ridges 18*a* and 19*a* with valleys 18*b* and 19*b* therebetween. These ridges may be formed in the plastic when it is first extruded or may be formed by a mechanical compression device such as opposed ribbed wheels which deform the plastic to form the ribs 18*a* and 19*a*. While the roughened portion is necessary only where the forces $F_1$ and $F_2$ are applied, for convenience, the roughened portion is continuous coextensive with the rib and groove elements.

For opening the bag, as illustrated in FIG. 1, the longitudinal forces $F_1$ and $F_2$ are applied in the direction tending to slide the rib and groove elements relative to each other. This may be done by applying a thumb and forefinger to the opposite sides of the bag and applying the forces in the direction of the fastener elements. The forces are preferably applied middistance between the side seams 13 and 14. When the forces are applied, as illustrated in FIG. 6, and as also illustrated in FIG. 1, the bag will tend to curl. This is because the forces $F_1$ and $F_2$ are transmitted along the rib and groove element to the ends of the rib and groove element where they are attached to each other at 34 and 35 at the side edges of the bag. The force $F_2$ is transmitted along the groove 16 as indicated by the arrowed force vector 20. This vector has a force vector component 23, taken parallel to the plane of the bag, which tends to curl the bag and has a lateral component 21, taken at right angle to the rib and groove, which tends to separate the rib from the groove. The stiffness of the joined rib and groove 15 and 16 may be referred to as the beam strength of the rib and groove elements, that is, their resistance to bending. The structure of the rib and groove elements is such that their resistance to bending is sufficiently great relative to the separation strength of the rib and groove elements so that they will pop open, that is, separate, when the curvature reaches the general curvature shown in FIGS. 1 and 6. If the rib and groove are made of too soft a material so that they have a too small beam strength, or if the fastening strength of the rib and groove 15 and 16 is too great, the elements will not separate by the method herein described. The beam strength should be sufficiently strong so that the elements separate before the bag top ends curl into a semicircle. That is, before they curl so that the radius of curvature is $\frac{1}{4}$ the width of the bag. Generally it has been found that a relatively strong closure can be provided and yet the closure will pop open with a relatively slight curling of the top as the forces F are applied, and the curvature will be generally such as that shown in FIG. 6 or even less.

It is also preferred that a plastic with a high slip be used for the rib and groove elements 15 and 16 so that they will not offer resistance to relative longitudinal movement as the forces $F_1$ and $F_2$ are applied.

FIG. 5 shows the rib and groove elements after they have been separated and are ready for reclosing. When separation has been accomplished by the ends popping open in the manner shown in FIG. 1, the operator can insert his finger down into either of the loops and pull apart the remaining interlocked center portion which is the force location where $F_1$ and $F_2$ were applied. The bag can then be loaded or unloaded, and the fastener reclosed by applying lateral forces as shown by the forces $F_3$ and $F_4$ in FIG. 5. When the closing force is applied manually, this is usually done by pressing the fasteners together and then sliding the thumb and forefinger along the length of the rib and groove elements.

While the foregoing structure and operation has been described in connection with a bag where the fasteners or rib and groove elements are integral with the bag walls, the same principles may be applied to fastener strips. In fastener strips two flat strip portions carry the rib and groove elements, and these strip portions are eventually attached to the top walls of a bag. Such strips are shown at 26 and 27 in FIG. 7 with the rib element 28 on the strip 26 and the groove element 29 on the strip 27. The outer surfaces of the strips have a frictional surface means at 30 and 31 respectively. The strips will have to be attached to each other at spaced locations for the opening process so that forces in opposite directions can be applied parallel to the rib and groove elements to cause the curvature and the forced separation of the rib and groove elements.

In operation with the structure shown in FIG. 1, the bag is received closed with the rib and groove elements 15 and 16 interlocked. The bag is opened by applying forces in the direction $F_1$ and $F_2$ such as by pushing a thumb and forefinger in opposite directions parallel to the rib and groove elements. This will cause the ends of the bag to curl and the lateral separation force component shown at 21 in FIG. 6 will force the rib and groove elements apart opening the ends of the bag as shown by the looped portions in FIG. 1. A finger can then be inserted into the looped portions to pull the fastener fully apart. For reclosing, pressure is applied along the rib and groove elements causing them to rejoin. Thus, it will be seen that I have provided an improved bag construction which provides for simple rapid opening eliminating the need for fumbling and attempting to locate the separate flaps at the top and eliminating the need for using two hands to grip and pull the flaps apart. While the opening of the bag is principally described in connection with manual opening, the same principles can be utilized with the structure of the invention for mechanical opening using a force applying means that simulates the action of the thumb and forefinger in attempting to slide the rib and groove elements relative to each other in an axial direction.

While separation of the rib and groove elements may be accomplished by permitting the bag top to freely curl as illustrated in FIG. 6, lateral restraint may be applied to limit the amount of curling. For example, a lateral restraining force tending to prevent curling may be applied at 34 and at 25' at the curl after the top has curled alightly such as an amount shown in FIG. 6.

These lateral forces applied to limit the curling will augment the separation effects and where fastener strips having a beam strength are used, by restraining the curl of the bag top, the excessive bending or curling of the top that might occur is prevented, and separation of the rib and groove elements is assured. While the force required to separate the rib and groove elements is determined by the design of the rib and groove itself, and a maximum strength closure should be provided for the bag which is being used, it is preferred that the rib and groove separate or open with a lateral force in the range of 2 to 7 pounds. The choice of this force needed to separate the rib and groove will be related to the beam strength of the combined rib and groove elements and whether the curling of the top will be restrained at the time the forces $F_1$ and $F_2$ are applied and to the slip content of the rib and groove elements.

While the bag arrangement is shown with a single rib element and a single groove element in a preferred form, it will be understood that the principles of the invention can be utilized by a closure which has plural sets of matching ribs and grooves. For example, with reference to FIG. 2, instead of one rib 15, two ribs may be employed, and instead of one groove 16, two grooves may be employed, and the ribbed outer surfaces 18 and 19 will be opposite the ribs and grooves. It is also possible to have a rib and groove on one wall of the bag and a corresponding matching rib and groove on the other side of the bag.

We claim as our invention:

1. An improved reclosable bag construction comprising in combination:

a bag having front and back walls attached by seams at their side edges;

continuous elongate interlocking separable rib and groove elements along confronting faces of the walls adjacent the top of the bag; said rib and groove elements being interlockable by the application of closing pressure applied laterally to the walls forcing the rib interlockingly into the groove; said rib and groove elements being axially slidable relative to each other;

and a frictional surface means at the outer surface of said walls at the rib and groove for applying local forces along the rib and groove at a force location intermediate the bag edges in opposing directions parallel to the rib and groove so that said rib and groove will separate laterally between said force location and the bag edges.

2. An improved reclosable bag construction constructed in accordance with claim 1:

wherein said rib element is arrowhead shaped and said groove is complementary shaped to receive the rib.

3. An improved reclosable bag construction in accordance with claim 1:

wherein said rib and grooves have a lateral separation force resistance in the range of 2 to 7 pounds.

4. An improved reclosable bag construction in accordance with claim 1:

wherein said rib and groove are formed of a plastic having a slippery surface so that the rib and groove slip longitudinally relative to each other with relative ease.

5. An improved reclosable bag construction in accordance with claim 1:

wherein said frictional surface means comprises a roughened surface.

6. An improved reclosable bag construction in accordance with claim 1:

wherein said frictional surface means comprises a series of raised ridge portions extending laterally of the direction of the rib and groove elements with recessed portions between the ridge portions.

7. An improved reclosable bag construction comprising in combination:

a bag having front and back walls attached by seams at their side edges;

continuous elongate interlocking separable rib and groove elements along confronting faces of the walls adjacent the top of the bag; said rib and groove elements being interlockable by the application of a closing pressure applied laterally to the walls forcing the rib interlockingly into the groove; said rib and groove elements being axially slidable relative to each other; said rib and groove elements having a longitudinal beam strength resistance to bending sufficiently great relative to the separation strength of the rib and groove elements that the application of opposing longitudinal forces to the rib and groove elements intermediate the edges of the bag will cause the rib and groove elements to curl and the resistance to curling will cause the rib and groove elements to separate.

8. An improved reclosable bag construction in accordance with claim 7:

wherein said beam strength resistance to bending is sufficiently great so that the rib and groove elements will separate before the curl of the rib and groove elements reaches a radius $\frac{1}{4}$ of the length of the rib and groove elements.

9. Improved reclosable interlocking fastener elements comprising in combination:

continuous elongate interlocking separable fastener strips having rib and groove elements on confronting faces; said rib and groove elements being interlockable by the application of a closing pressure applied laterally to the strips forcing the rib interlockingly into the groove; said rib and groove elements being axially slidable relative to each other;

and a frictional surface means on the outer surfaces of said strips at the rib and groove elements for applying local forces along the rib and groove elements at a force location intermediate the bag edges in opposing directions parallel to the rib and groove so that said rib and groove will separate laterally;

and means for fixedly attaching the rib and groove elements to each other at spaced spots of attachment with said force location between the spots of attachment so that as said local force is applied the interconnected rib and groove elements will curl and separate.

10. Improved reclosable interlocking fastener elements constructed in accordance with claim 9:

wherein said rib and groove elements are formed of a relatively slippery plastic so as to be able to slide longitudinally relative to each other and form said curl.

* * * * *